United States Patent [19]

Newquist et al.

[11] 4,146,221

[45] Mar. 27, 1979

[54] PLATFORM PADDLE TENNIS COURT DECK AND ASSOCIATED EQUIPMENT

[76] Inventors: Barbara L. Newquist, One Artillery La., Scarsdale, N.Y. 10583; Scott C. Newquist, 155 E. 88th St., New York, N.Y. 10028

[21] Appl. No.: 791,709

[22] Filed: Apr. 28, 1977

[51] Int. Cl.[2] ..... A63B 69/38; F24J 3/02

[52] U.S. Cl. ..... 272/3; 34/237; 165/53; 237/69

[58] Field of Search ..... 272/3; 273/29 R, 29 A, 273/30; 237/1 R, 1 A, 69; 62/235, 260; 165/45, 168, 170, 49, 47; 137/362; 404/71; 34/237

[56] References Cited

U.S. PATENT DOCUMENTS

| | | | |
|---|---|---|---|
| 2,240,951 | 5/1941 | Hamjy | 165/49 X |
| 2,295,142 | 9/1942 | Vetter | 62/235 |
| 2,505,622 | 4/1950 | McKee | 237/1 R |
| 2,598,842 | 6/1952 | Scott | 237/69 |
| 2,726,593 | 12/1955 | Lahti | 237/69 X |
| 3,779,547 | 12/1973 | Pappas | 272/3 |
| 3,818,892 | 6/1974 | Von Kohorn | 34/237 X |
| 3,875,996 | 4/1975 | Von Kohorn et al. | 34/237 X |
| 3,904,193 | 9/1975 | Patterson | 272/3 |
| 3,935,687 | 2/1976 | Vaughn et al. | 272/3 X |
| 3,951,406 | 4/1976 | Rock | 272/3 X |

*Primary Examiner*—Richard C. Pinkham
*Assistant Examiner*—Arnold W. Kramer
*Attorney, Agent, or Firm*—Watson, Leavenworth, Kelton & Taggart

[57] ABSTRACT

Platform paddle tennis court including suitable base support structure, marginal enclosing taut screening and a platform deck. This deck may be made up of a plurality of parallel, hollow deck panels extending in one of the directions of transversely and longitudinally of the usual court area and defining at least one section or one of a plurality of sections, which may constitute a deck portion margined on one side by the central transverse net line. Each deck panel is substantially rectangular in cross section and defined by lateral top and bottom sheets and laterally-spaced upright side sheets of heat transfer material successively connected together along meeting corners thereof in substantially fluid-tight joints for defining together an elongated, hollow, tubular duct-defining interior. A plurality of flow passage defining conduits are mounted transversely and laterally below the deck panels in appreciably spaced relation relative to the lengths of said tubular ducts with each constituting a heating fluid manifold. A heating fluid source is provided to supply to the flow passages of at least some of the transverse manifold conduits flowing heating fluid and to conduct away therefrom such flowing heating fluid. Structure defines communicative passages between the flow passage interiors of the duct-defining panels and manifold conduits whereby such heating fluid may be circulated substantially throughout the deck panel interiors for heating the lateral top sheets of these panels.

12 Claims, 6 Drawing Figures

FROM FURNACE
RETURN TO FURNACE
FROM FURNACE

PLATFORM PADDLE TENNIS COURT DECK AND ASSOCIATED EQUIPMENT

BACKGROUND AND SUMMARY

The present invention relates to platform paddle tennis court constructions which must satisfy by outdoor installations thereof during winter seasons a demand for satisfactory usage under frequently trying weather conditions. This may require easy removal and effective elimination from the deck playing surface of ice and snow, maintenance of such surface in a manner assuring reliably safe underfooting, and relatively uniform firm support of all playing areas. Prior proposals in the art are advanced in the Eaton U.S. Pat. No. 2,205,398 of June 25, 1940; and Vaughn et al. U.S. Pat. No. 3,745,729 of July 17, 1973; and Pappas U.S. Pat. No. 3,779,547 of Dec. 18, 1973.

The Eaton expired patent teaches one of the early types of such platform tennis court constructions featuring deck and side enclosing screening employing wooden subassemblies and parts assembled by skilled carpentry. Nothing taught therein is employed in the presently claimed invention.

In the Pappas patent it is disclosed that upstanding poles conveniently may be mounted upon the top ends of piers or posts margining the exterior edges of the rectangular court, the top ends thereof also providing supports for the marginal edges of the court. These posts cooperatively support a continuous, horizontal top rail structure from which is suspended the top edge of screening or netting that extends down to a lower horizontal rail structure which is likewise supported by these posts. These upright posts are shown to be flexed inwardly toward the margining court areas so that lateral stress is applied at the top edge of the screening assembly laterally outward from the court area to assure tautness of such screening. While this structure may be worthy of embodiment in a platform paddle tennis court construction which includes the platform deck construction of the present invention it is not claimed herein.

The Vaughn et al. patent teaches the production and assembling of metal parts to produce certain complicated and expensive assemblies of many parts to construct a deck structure and supporting base assembly beneath the latter, and also the screen enclosure supported by this base construction for margining the deck structure completely. As to heating it is merely suggested in one sentence of the summary thereof that a space heater may be installed below the platform deck for readily heating this metal platform tennis court without proposing anything more specific structurally.

It is a general object of the present invention to provide unique structural features in the metal deck construction of the present invention which will elevate the temperature thereof in an unusual manner with minimum loss of heat while overcoming problems of such prior art teachings with the realization of considerable economy in costs of construction, maintenance and operation.

This platform paddle tennis court includes, with suitable base support structure and marginal enclosing taut screening, a novel platform deck construction. This platform deck construction embodies a plurality of parallel, hollow deck panels extending in one of the directions of transversely and longitudinally of the usual court area and defining at least one of a plurality of sections together defining a portion of the deck area, and such portion may be a substantially half portion margined on one side by the central transverse net line. Each of these deck panels is substantially rectangular in cross section and defined by lateral top and bottom sheets and laterally-spaced upright side sheets, preferably but not necessarily of heat transfer material, successively connected together along meeting corners thereof in substantially fluid-tight junctures for defining together an elongated, hollow, tubular duct-defining interior. Each such "juncture" may be an integral continuation or, more specifically, a joint of opposed parts. A plurality of flow passage defining conduits are mounted transversely and laterally below the deck panels in appreciably spaced relation relative to the lengths of the tubular ducts with each constituting a heating fluid manifold. Heat supply equipment delivers to the flow passages of at least some of the transverse manifold conduits flowing heating fluid and to carry away such flowing heating fluid. Communicative passages may connect the flow passage interiors of some of the duct-defining panels and manifold conduits whereby such heating fluid may be circulated substantially throughout the deck panel interiors for heating the lateral top sheets of the panels, and if the heating fluid is to be recirculated suitable return conduits may connect such interior flow passages back to the heating source.

Since such a platform paddle tennis court deck, or the playing surface thereof within the enclosing screening, is substantially thirty feet wide and sixty feet long (30′×60′) each of the two end sections on opposite sides of the transversely medial net dimensionally is about thirty feet long and thirty feet wide (30′×30′). Preferably, each of the deck panels may be about thirty feet long (30′l.) and about five feet wide (5′w.), and it may be preferred that they be laid longitudinally in each deck half section to extend from the deck transverse end thereof to the transverse medial net line, although they may be arranged to extend transversely parallel from one side of the deck across to the other side thereof, which may be accommodated by the installation either therebelow or at the ends thereof, by manifold conduits along the sides of the deck sections rather than crosswise thereof.

The hollow interior chamber of each of these deck panels is subdivided into a plurality of relatively narrow, parallel ducts, each of which may be, by way of example, about four and a quarter inches wide and about four inches high, with these ducts being defined on their sides by relatively stiff, elongated and upstanding partitions. These partitions effectively distribute the mobile and rapidly shifting loads of the players imposed upon the top sheets of the deck panels, and also permit economical employment of relatively thin or light gage sheet metal for the fabrication of at least these top sheets of such panels.

With the preferred longitudinal orientation of the deck panels, so that the interior ducts thereof extend longitudinally of the deck area and with each deck half section terminating transversely at or near the transverse net line a variety of patterns or arrangements and differing constructions of the supplying and exhausting conduits or manifolds are practically possible. For example, assuming approximate alignment and close or relatively non-leaking abutment or connection substantially at the transverse net line of the deck panels and their interior ducts on opposite sides of this net line, the deck and terminals of these panels and their interior ducts may effectively be closed off thereat in any suitable manner and transverse hollow manifolds may be mounted below or substantially aligned with such panel ends with provision for flow connections between the ducts thereat and the adjacent manifold chamber. Such mounting of the manifold below the ends of the panels may involve any suitable blockage of the duct ends at such deck end, such as by transverse end plates, and openings in the bottom sheet of each panel within each duct preceding its end blockage and down directly into the manifold therebeneath are simple and effective flow transfers. Also, these manifolds may be open top channels or troughs having their upwardly-extending sidewalls suitably connected or sealed to the panel bottom sheets on opposite sides of the openings in the latter. With one end of each such manifold closed off, the other end thereof may have suitably connected thereto at the deck edge a flow conducting conduit, with one at one deck end leading from a heater, such as a hot air furnace, and the other one at the opposite deck end leading back to this furnace for return of the same air now in cooler condition to be reheated.

Such channels at opposite ends of the deck area may serve the dual purpose of duct blockage and heated medium supply or exhaust by merely turning each such channel on its side and sealing the edges of the channel sides to the adjacent panel end so that the ducts are directly flow connected to this channel manifold interior. The end of this channel which is not connected to the supply or return conduit will be suitably blocked.

As to possible variants of the heating ductwork the supply manifolds may be transversely mounted beneath both ends of the deck with a single exhaust manifold transversely mounted in the general vicinity of the medial transverse net line. In this event, the hot medium flows into the panel ducts at both ends of the platform deck and along only about one-half of the length of deck area before being exhausted as cooler medium into the central manifold for return to the heater. In this pattern of ductwork the central exhaust manifold may be replaced by a pair of transverse exhaust manifolds so that each deck half section has transverse manifolds at both ends of all of its panels. In the latter event the panels are interchangeable and when unloaded at a construction site do not require orientating care in assembling. Other suitable arrangements of these relative parts will readily occur to one skilled in this art and in mechanics.

It has been found to be desirable as economically advantageous with respect to service costs of operating such a platform paddle tennis court to apply suitable protective sheetings to strategical areas of the deck panels. This may involve such applications to either or both of the top surface of the top sheet and the bottom surface of the bottom sheet of the deck panels. For example, a ply of fiberglass reinforced plastic of relatively thin body may be desirably laminated or otherwise attached to the top surface of each panel top sheet beneath the overlying play surface rough coat. Also, some suitable insulating material or coating may be laminated or attached to the bottom surface of the bottom sheet of each deck panel to reduce heat loss to underlying ground material, etc.

The assembly of deck panels may be supported advantageously on suitable piers margining the edge zones of the sides and ends of the assembled deck with the margining piers also conveniently supporting upright posts laterally outward of the deck margins for support of the enclosing taut screening.

Other objects of the invention will in part be obvious and will in part appear from reference to the following detailed description taken in connection with the accompanying drawings, wherein like numerals identify similar parts throughout, and in which.

Figure 1A:
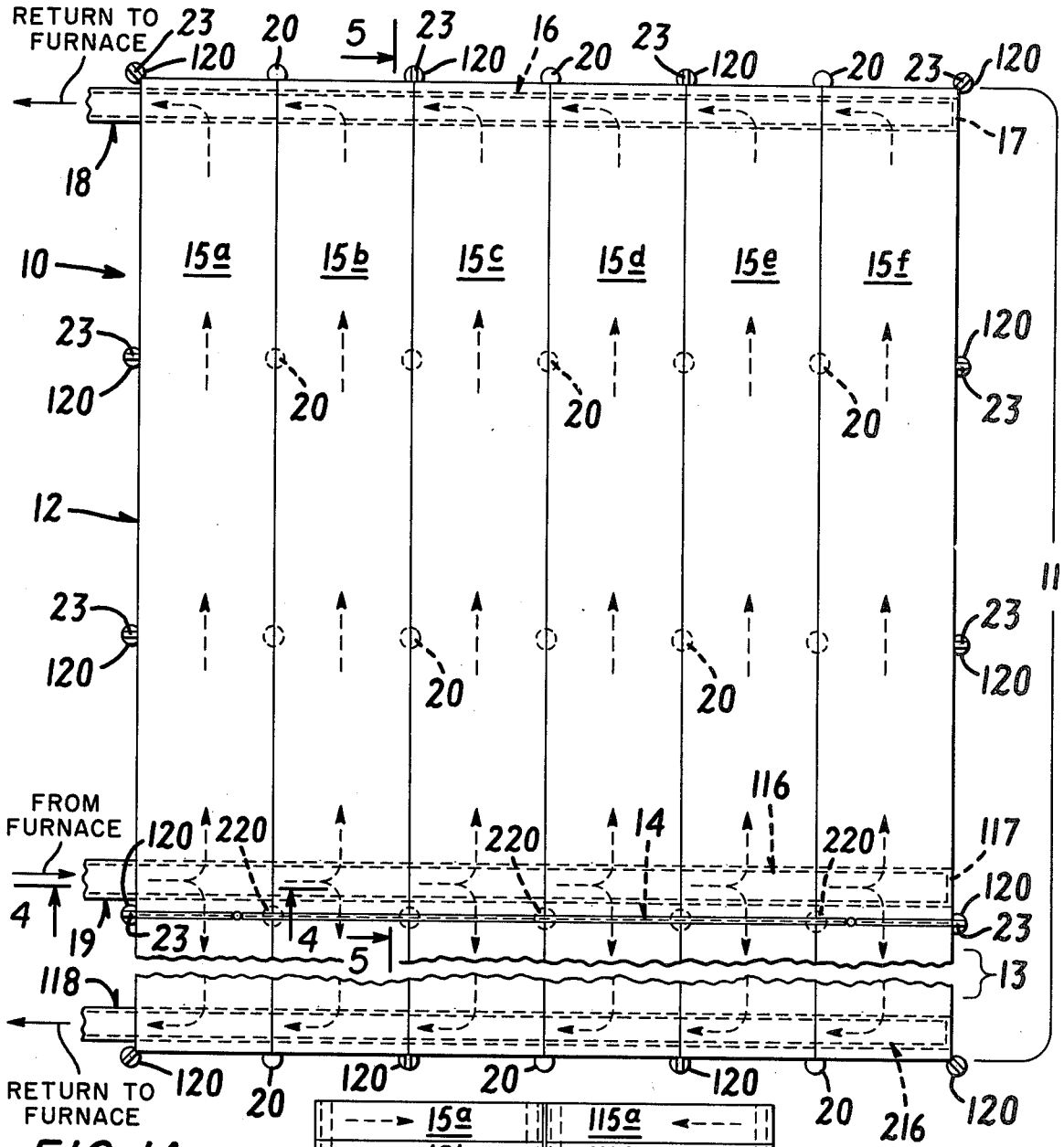
FIG. 1A is a plan view to reduced scale, with parts broken away, of the deck of a platform paddle tennis court and associated equipment with respect to a heating system embodied therein and support structure for this deck of the present invention.
Figure 2:
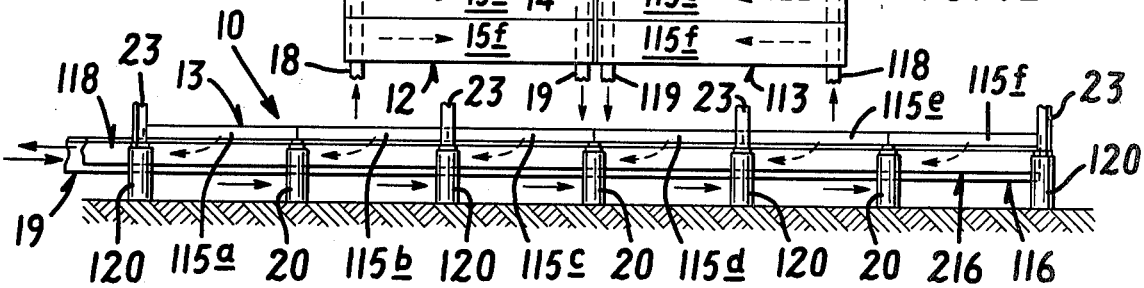
FIG. 2 is an end elevational view of the platform deck structure and associated equipment shown in FIG. 1A, which could be that of the FIG. 1B platform deck and its associated equipment.

As will be seen from FIGS. 1A and 2 an embodiment of the platform paddle tennis court 10 embodies a platform deck 11 consisting of two end sections 12 and 13 arranged on opposite sides of a transverse net line 14. Each such end section, e.g., as indicated at 12, consists of a plurality, such as six, parallel, hollow deck panels, which are preferably arranged longitudinally in such end section and in relatively close parallelism with some drainage spacing. The six longitudinal hollow deck panels in the deck section 12 are generally alike and are thus referenced 15*a*, 15*b*, 15*c*, 15*d*, 15*e*, and 15*f*. Since the other deck end section 13 is similar in reverse order on the opposite side of the transverse net line 14 the major central areas thereof have been omitted as unnecessary and thus they are identified by reference numerals 115*a*, 115*b*, 115*c*, 115*d*, 115*e*, and 115*f*, as is indicated in the end elevational view of FIG. 2.

Any suitable means may be employed for detachably connecting the opposed and adjacently located longitudinal sides of the successive pairs of such hollow deck panels, e.g., 15*a* and 15*b*, 15*b* and 15*c*, 15*c* and 15*d*, 15*d* and 15*e*, and 15*e* and 15*f*. Consequently, this assembly forms a unitary structural assemblage and, if desired, the fastening means for so joining them together may be supplemented by other suitable means.

Since heating fluid is to be flowed through the hollow interiors of such deck panels, transverse manifolds are employed for connection to such interior flow passages at both ends of the deck end section 12 illustrated in FIG. 1A. For this purpose such an elongated, hollow manifold 16 may be mounted beneath the free far transverse ends of such deck panels 15*a*–15*f* incl., shown in the upper major portion of FIG. 1A and relatively close to such panel ends. It is indicated at 17 that one end of such manifold is closed off and that the other end 18 extends outward to be connected as an exhaust conduit leading to a heating unit or furnace. If desired, supply of the flowing hot medium may be effected by a conduit 19 leading from the heating unit or furnace with connection to the adjacent end of a transverse manifold 116 mounted beneath the ends of the hollow deck panels 15*a*–15*f* incl. transversely and in the vicinity of the net line 14. The manifold 116 also has its terminal end 117 blocked. As will be explained later flow connection is provided between the interiors of the hollow deck panels 15*a* to 15*f* incl. and the return manifold 16 at the free ends thereof, as well as to the supply manifold 116 near the other ends thereof in the vicinity of the transverse net line 14, and the means for such intercommunication is illustrated in following figures and will be described hereinafter. Since the other deck end section 13 is similar in reverse order to the deck section 12 it is likewise equipped with an exhaust manifold 118 which also is connected to the heating unit or furnace.

It is to be understood from FIGS. 1A and 2 to 5 incl. that support for each of the court half sections 12 and 13 preferably is provided by a plurality of piers, which may be in the form of pilings, referenced 20 and 120. Each of these piers, 20 and also 120, is provided with a leveling platform plate 21 or 121 which may be suitably supported upon vertically adjustable bolt and nut assemblies 22 for proper positioning such support plates. Such supporting piers along the transverse end margins of the court are alternately arranged so that the piers 20 alternate with the piers 120, the chief difference being that the latter support upon their leveling plates 121 suitable wire screening support posts 23. The leveling plates 21 suitably carry cushioning resilient blocks 24. Piers 120 are spaced from each other along the longitudinal side margins of the court.

Figure 3:
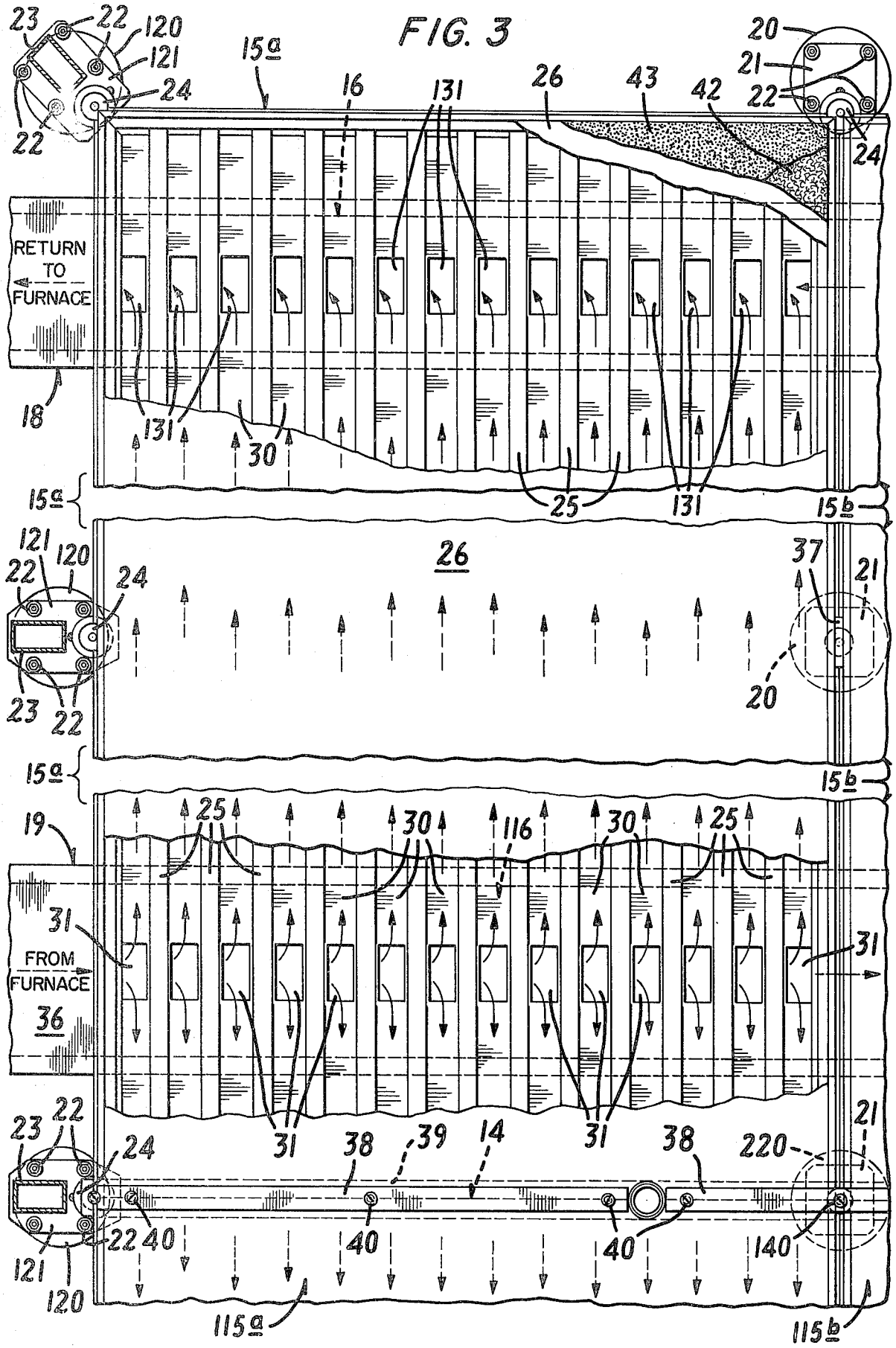
FIG. 3 is an enlarged plan view of a portion of the platform deck structure shown in FIG. 1A, with parts broken away, and showing structural details of one of the deck panel units extending from the transverse end of the deck to the transverse net line and adjacent portions of the next adjacent deck panel in the same deck half section and also that in the deck half section beyond the net line.
Figures 4, 5:
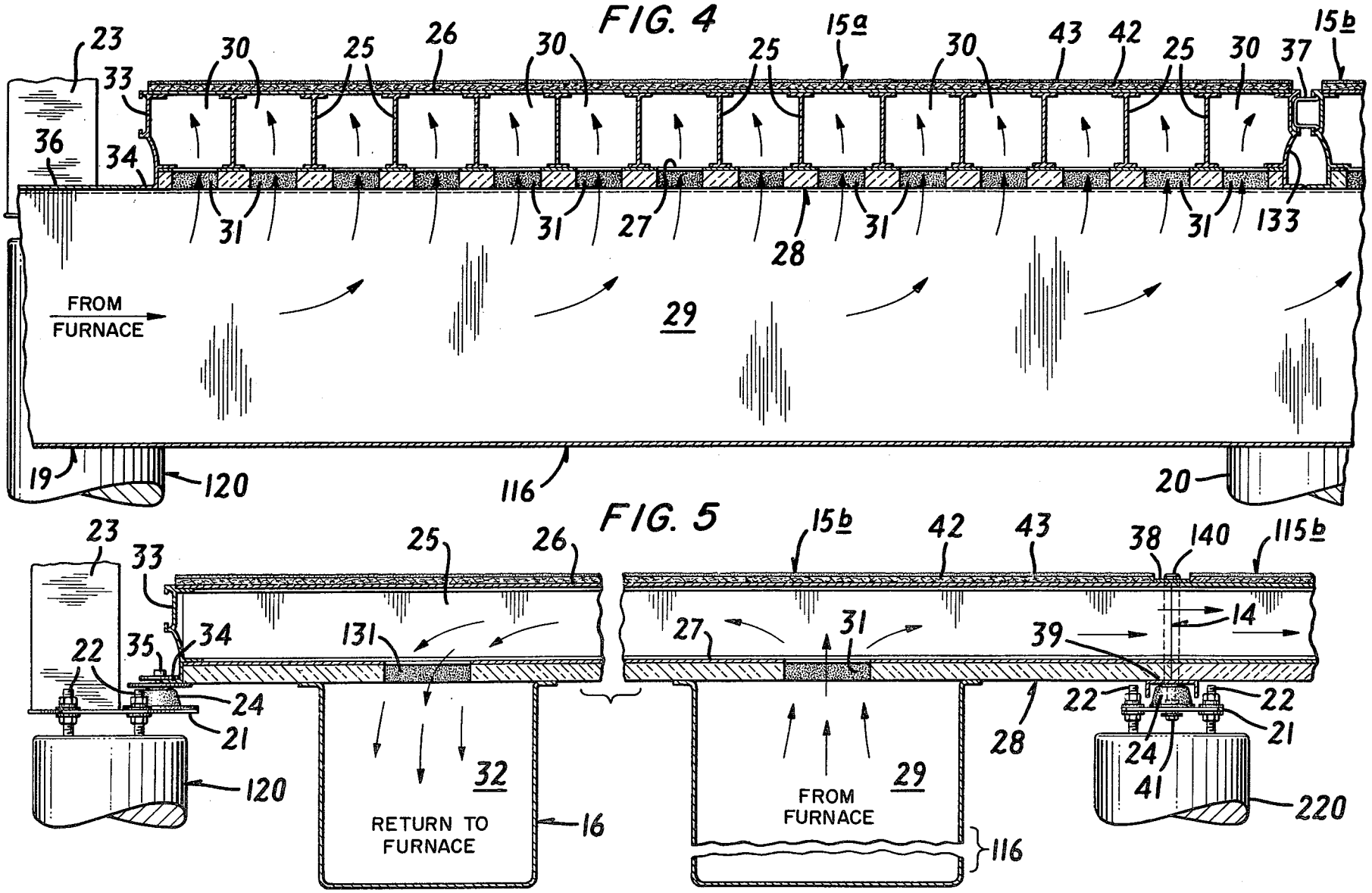
FIG. 4 is an enlarged sectional view to larger scale taken substantially on line 4—4 of FIG. 1A, with parts broken away.
FIG. 5 is an enlarged sectional view taken substantially on line 5—5 of FIG. 1A, with parts broken away.

It will be seen from FIGS. 3, 4 and 5 that each of the supply manifold 19 and exhaust manifold 18 preferably is in the form of a trough-shaped channel which is mounted in any suitable manner beneath the plurality of hollow panels 15*a* to 15*f* incl., and 115*a* to 115*f* incl. From the side edge of each of the court half sections 12 and 13 such channel manifolds are suitably connected to or converted into rectangular conduits for confining the fluid flows therethrough, e.g., hot air, from the furnace and cooling air back to the furnace.

Each of the panels 15*a* to 15*f* incl. and 115*a* to 115*f* incl. is subdivided into longitudinal ducts by a plurality of laterally-spaced and longitudinally-extending, relatively stiff and elongated partitions 25. Such partitions may be in the form of vertical slabs or flat beam plates, and preferably for convenience and strength may be formed of metallic I-beams, made from any suitable metallic material, e.g., aluminum alloy. It may also be preferred that the top sheet 26 of each such panel, e.g., 15*a* illustrated in FIG. 4, as well as the bottom sheet 27, be formed of suitable lightweight metallic composition, e.g., aluminum alloy. The I-beams 25 provide the desired support at relatively frequent intervals which gives a desired sense of firm support with suitable small degree of flexibility considered by players to be desired simulations of prior platform paddle tennis court constructions of superior quality and action. Of course, insofar as the present invention is concerned, the material from which such deck panels and their interior chamber subdividing partitions or I-beams 25 is not limited to aluminum alloys since sheetings of other metallic compositions or other suitable types of materials may be used, and structural parts may be constructed from various types of suitable materials. For example, stainless steel, etc., and some types of plastics might be employed for such sheets and parts; but currently aluminum alloys are relatively economical to purchase, ship, manipulate and are adaptable to relatively simple fabricating procedures.

Also, it may be preferred for heat conservation to insulate the bottom plate or sheet 27 of each of the deck panels in each of the court half sections 12 and 13. For example, as may be best understood from FIGS. 4 and 5 there may be attached to each panel bottom sheet a layer 28 of suitable insulating material, which may be a coating that is sprayed thereon or layer that is laminated thereto.

Since the interior 29 of the supply manifold channel 19 is to be flow connected in a simple and practical manner to the ducts 30 intervening the dividers or I-beams 25 and the top and bottom panel sheets 26 and 27 this is preferably accomplished by merely providing a plurality of apertures or holes in aligned fashion within the bottom panel sheet 27, and also the underlying layer of insulative material 28, if present, as is illustrated at 31 in FIGS. 4 and 5. Likewise, the interior 32 of each of the exhaust conduits 18 is connected to such longitudinal ducts 30 at remote points by similar apertures or holes 131 in the same panel bottom sheet 27, and the underlying insulative layer 28, if present.

Figure 1B:
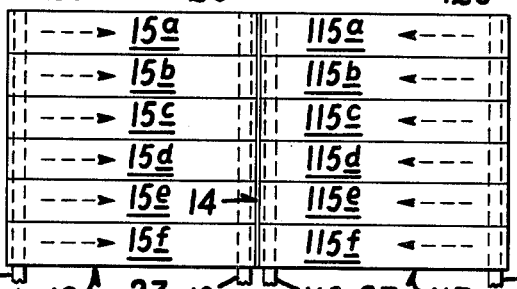
FIG. 1B is a top plan view to smaller scale than FIG. 1A of a similar platform paddle tennis court deck chiefly differing from that of FIG. 1A in the provision of an additional manifold conduit.

It will thus be seen that the supply manifold and its continuation chambered channel 19 supplies hot fluid, e.g., air, through the communicating holes 31 to the panel ducts 30 which extend to the exhaust manifold 16, and also in the opposite direction through the similar ducts of the panels 115*a* to 115*f* incl. for ultimate exhaust through the exhaust manifold 116 provided in the opposite end of the court area. It is also to be understood with the aid of the illustrative showing in FIG. 1B that the manifold conduit 19 may be supplemented by a similar manifold conduit 119 in the near vicinity, but on the opposite side of the transverse net line 14 and, if desired, the flows through such manifolds may be reversed since the flows through the panel ducts are now substantially equal in both half sections of the court area without any appreciable change in operation other than that which might be dictated by the physical location of the furnace relative to the court area half sections.

It will also be noted from FIGS. 4 and 5 that the sidewalls 33 and 133 which close off the opposite sides of the panel internal chamber are in the form of separate strips which have their tops and bottoms respectively connected in joints to the panel top sheet 26 and the panel bottom sheet 27. The particular shape of such panel sidewalls 33 and 133 is merely exemplary and has been adapted to structural details of connectors intervening opposed sidewalls of the chambered panels 15*a* to 15*f* incl. and 115*a* to 115*f* incl. Further, it will be noted that the sidewall 33 is provided with a lateral footing flange 34 in FIG. 4 so that it may be employed for load transfer in relation to a top clamping assembly 35 (FIG. 5) of the support footing 24 carried by the leveling plate 121. Also, it will be noted from FIG. 4 that beyond or laterally outward of such lateral flange 34 of the sidewall 33 the open top of the supply manifold conduit 19 has been covered over by a supplemental lateral plate 36 to convert it to a supply duct leading to such manifold panel.

It will also be noted from FIGS. 1A and 2 to 5 incl. that the leveling plates 121 of the piers 120 also support the upright marginal posts 23 on which is tautly stretched the marginal screening.

Since the plurality of parallel hollow panels 15*a* to 15*f* incl. and/or 115*a* to 115*f* incl. are to be conveniently constructed in a factory facility and then transported to the court site, there for ready assembling, construction of the longitudinal sidewalls 33 and 133 of each such panel are so formed as to make anchorages of such sides to supporting means and to opposed sides of the next successive hollow panels conveniently and readily attainable. For example, it will be seen on the right side of FIGS. 3 and 4 that such ready interconnection may be effected at any suitable point or in the vicinity of support piers 20 by readily attachable clip means 37. Obviously, a variety of different types of readily detachable and easily demountable fastening devices may be employed for performing such connective attachment functions. It will also be understood from FIGS. 3 and 5 that at the net line 14 the abutted ends of the hollow panels 15*a* to 15*f* incl., and 115*a* to 115*f* incl., are to be connected by convenient means which may be in the form of transversely-extending metallic strap sections 38 suitably lapping the top marginal edge zones of such abutting ends of these hollow panels (FIGS. 3 and 5), with marginal opposed edges of the bottom insulative layer 28 likewise lapped by a transversely extending strap or inverted channel 39. Such lapped edge zones of the abutted ends of these hollow panels may be securely anchored together by a plurality of tie bolts 40 and 140. Each such tie bolt has its elongated shank extending down through a spacer tube with the bottom end of the latter abutted by the inverted channel 39 having a plurality of longitudinally-spaced holes. The bottom threaded end of each such tie bolt extends down therethrough for receiving therebelow the tightening threaded nut. These spacer tubes prevent crushing of the abutted panel ends when such tie bolts are tightened. The bottom ends of the tie bolts 140 at the meeting corners of four panels, e.g., 15*a*, 15*b*, 115*a*, and 115*b*, conveniently extend down through such spacer tube and then on down through the support block 24 as well as the leveling plate 21 therebelow for reception of its tightening nut 41 therebeneath. Obviously these anchoring and support functions of the abutted ends of the hollow panels along the net line to secure the opposed court half sections together may be accomplished by a variety of types of mechanisms or anchoring means that will readily occur to a skilled mechanic.

It has been indicated that it may be preferred to provide a ply or layer of fiberglass reinforced plastic of relatively thin body that may be conveniently laminated to the top surface of each of the panel top sheets, and beneath an overlying play surface rough coat which may assure a desired footing security during the usual rapid movement of a player. Such a fiberglass reinforced plastic layer tends to render the panel top sheet puncture resistant, adds strength thereto and improves adherence of the top rough coat. Such features are illustrated in the upper right hand corner of FIG. 3, and in FIGS. 4 and 5, wherein it is indicated that the panel sheet 26 is covered by, e.g., fiberglass laminae 42, in turn overlaid by a standard play surface rough coat 43.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is the novel subjects matter defined in the following claims.

1. A platform paddle tennis court comprising, in combination with suitable base support structure and marginal, enclosing taut screening; of a platform deck comprising (1) a plurality of parallel, hollow deck panels extending in one of the directions of transversely and longitudinally of the usual court area, each of said deck panels being substantially rectangular in cross section and defined by lateral top and bottom sheets and laterally-spaced upright side sheets successively connected together along meeting corners thereof in substantially fluid-tight junctures for defining together an elongated, hollow, tubular duct-defining interior;

(2) a plurality of upstanding and relatively stiff, elongated partitions arranged in transversely-spaced relation and extending longitudinally substantially from end to end within the interior space of each of said deck panels with subdivision of this space into a plurality of substantially parallel ducts and providing for the top sheet of each of said panels appreciable load-bearing strength;

(3) flow passage defining conduit means mounted transversely of said deck panels in appreciably spaced relation relative to the lengths of said tubular ducts constituting a heating fluid manifold;

(4) means to supply to the flow passages of at least some of said transverse manifold conduit means flowing heating fluid; and (5) means defining communicative passages between the flow passage interiors of said duct-defining panels and manifold conduit means whereby such heating fluid may be circulated substantially throughout the deck panel interiors for heating the lateral top sheets of said panels.

2. The platform paddle tennis court deck and associated equipment as defined in claim 2 characterized by additional transverse conduit means constituting another heating fluid manifold adapted to conduct away flowing heating fluid.

3. The platform paddle tennis court deck and associated equipment as defined in claim 2 characterized by said plurality of hollow deck panels defining at least a part of one of the two end sections on opposite sides of the central transverse net line.

4. The platform paddle tennis court deck and associated equipment defined in claim 3 characterized by said plurality of panels defining together one of the two end sections of the court area and arranged substantially longitudinally of said court section and extending between the court transverse net line and the transverse court end on the same side of the latter.

5. The platform paddle tennis court deck and associated equipment defined in claim 4 characterized by the platform deck being equipped at each end of the court area with one of said manifold conduits arranged transversely of the court area substantially parallel to the transverse net line.

6. The platform paddle tennis court deck and associated equipment defined in claim 5 characterized by said panel bottom sheets being provided above said manifold conduits with openings communicating at least some of said panel ducts directly to the conduit flow passage therebeneath.

7. The platform paddle tennis court deck and associated equipment defined in claim 6 characterized by the provision of at least an additional such transverse manifold conduit mounted generally medially of the court area and transversely below said deck panels in the general vicinity of the transverse net line with similar openings in panel bottom sheets communicated directly to the conduit flow passage therebeneath.

8. The platform paddle tennis court deck and associated equipment defined in claim 6 characterized by each of said conduit manifolds being in the form of an open top channel before mounting with the communicating openings in the panel bottom sheets thereabove being located above the top open side of the manifold channel therebelow for intercommunication.

9. The platform paddle tennis court deck and associated equipment defined in claim 1 characterized by the suitable base support structure including piers mounted by and having top ends extending above the ground at locations appreciably spaced apart with a marginal series thereof arranged in spaced relation along the sides and ends of the platform deck and having deck supporting means on the top ends thereof on which marginal zones of the undersides of the platform deck mountingly seat, the top ends of said marginal piers also supporting laterally outward from the marginal zones of said deck a plurality of upright posts which support the enclosing taut screening.

10. The platform paddle tennis court deck and associated equipment defined in claim 9 characterized by said plurality of parallel deck panels having each successive pair therein, in which one side sheet of one is opposed to an adjacent side sheet of the next one, simultaneously supported at intervals by additional piers.

11. The platform paddle tennis court deck and associated equipment defined in claim 1 characterized by the bottom surface of the bottom sheet of each panel being covered by a layer of suitable insulative material attached thereto.

12. The platform tennis court deck and associated equipment defined in claim 1 characterized by the top sheet of each panel being covered by a layer of protective material attached thereto.

* * * * *

UNITED STATES PATENT AND TRADEMARK OFFICE

CERTIFICATE OF CORRECTION

PATENT NO. : 4,146,221

DATED : March 27, 1979

INVENTOR(S) : Barbara L. Newquist and Scott C. Newquist

It is certified that error appears in the above-identified patent and that said Letters Patent are hereby corrected as shown below:

At Col. 8, line 47 (claim 2), "as defined in claim 2" should read --as defined in claim 1--.

Signed and Sealed this

Tenth Day of July 1979

[SEAL]

Attest:

Attesting Officer

LUTRELLE F. PARKER

Acting Commissioner of Patents and Trademarks